US006155451A

United States Patent [19]

Pietruch et al.

[11] Patent Number: 6,155,451

[45] Date of Patent: Dec. 5, 2000

[54] SEALED METAL CONTAINER

[75] Inventors: Walter P. Pietruch, Belvidere, Ill.; Glenn S. Ceckowski, Laporte, Ind.

[73] Assignee: J. L. Clark, Inc., Rockford, Ill.

[21] Appl. No.: 09/476,859

[22] Filed: Jan. 3, 2000

Related U.S. Application Data

[63] Continuation-in-part of application No. 09/128,232, Aug. 3, 1998, Pat. No. 6,036,042.

[51] Int. Cl.[7] ..... B65D 6/00

[52] U.S. Cl. ..... 220/608; 220/62.22; 220/62.15

[58] Field of Search ..... 220/608, 62.22, 220/62.15

[56] References Cited

U.S. PATENT DOCUMENTS

| | | | |
|---|---|---|---|
| 226,347 | 4/1880 | Pecor et al. | 220/62.12 |
| 2,028,798 | 11/1933 | Murch | 220/62.12 |
| 2,413,093 | 7/1942 | Warth et al. | 220/62.12 |
| 3,905,507 | 9/1975 | Lyu | 220/608 |
| 3,912,109 | 10/1975 | Essex, Jr. et al. | 220/608 |
| 4,010,867 | 9/1975 | Jones | 220/608 |
| 4,181,239 | 1/1980 | Heiremans et al. | 220/62.12 |
| 4,199,622 | 4/1980 | Kokumai et al. | 220/62.12 |
| 5,060,818 | 10/1991 | Doi et al. | 220/62.12 |

*Primary Examiner*—Paul T. Sewell
*Assistant Examiner*—Troy Arnold
*Attorney, Agent, or Firm*—Leydig, Voit & Mayer

[57] ABSTRACT

A sealed metal container adapted for use with candles. The container is coated with a layer of sealing compound so that the side and bottom seams of the container do not leak flowable material. The container includes a stamp formed base which is characterized by having an internally upwardly directed dome upon which a candle wick carrying element may be securely located on an apex region of the dome. The sealing compound contains a mixture of synthetic wax with sufficient adhesive so that the compound bonds to the surface of the container. Appropriate ratios of synthetic wax and adhesive material are mixed together so that the sealing compound has sufficient flexibility. A method for forming a sealed metal container is also provided in which the sealing compound is melted, pressurized, and sprayed through a nozzle toward the interior surface of the container. The container may be preheated and rotated during spraying to ensure complete coverage.

19 Claims, 6 Drawing Sheets

Fig. 2
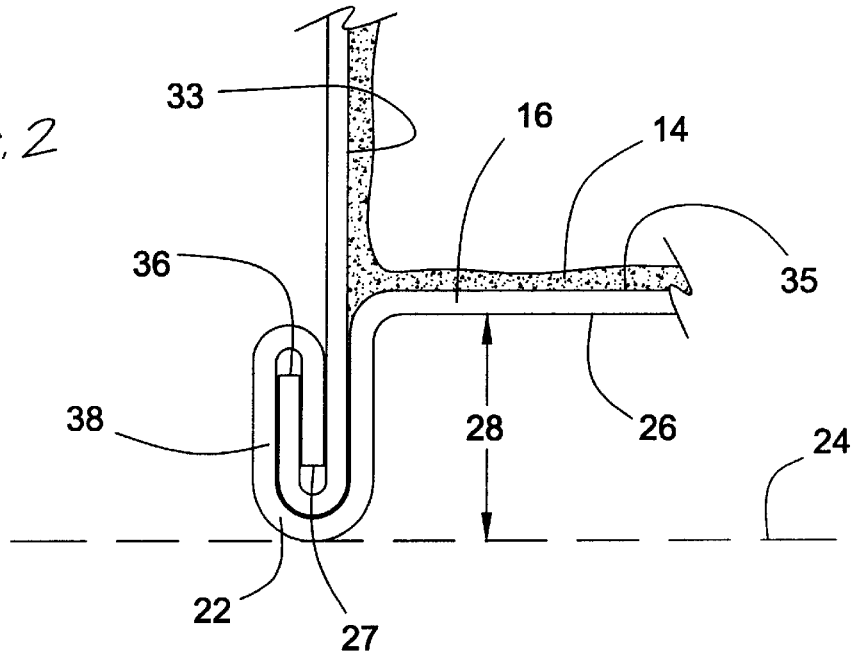
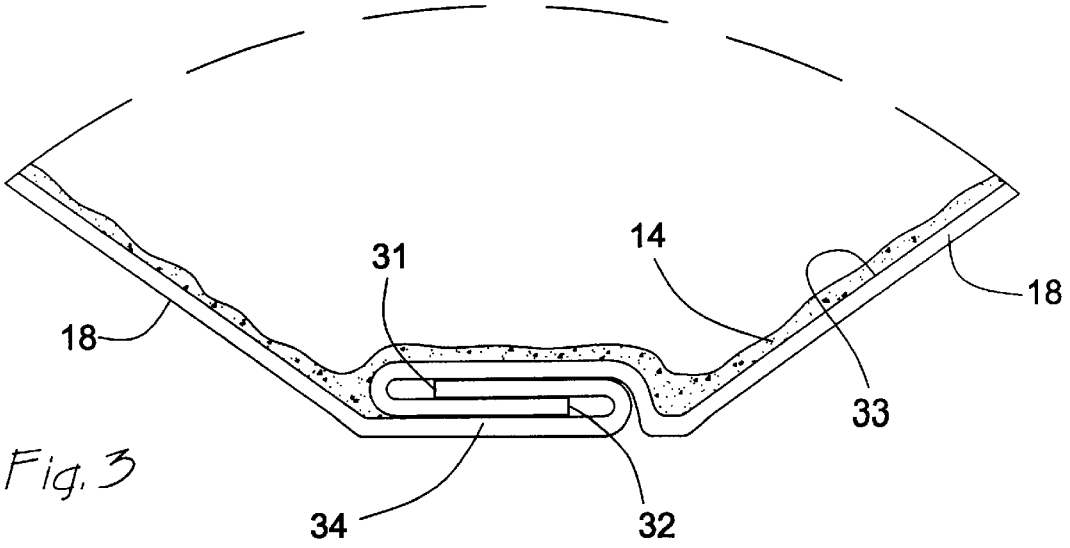
Fig. 3

SEALED METAL CONTAINER

This application is a continuation-in-part of U.S. patent application Ser. No. 09/128,232 filed Aug. 3, 1998, now U.S. Pat. No. 6,036,042.

FIELD OF THE INVENTION

The present invention generally relates to containers and, more particularly relates to sealed metal containers and methods for forming the same.

BACKGROUND OF THE INVENTION

A wide variety of products are packaged in metal containers. Metal containers are desirable because they are durable and provide a distinctive appearance. Metal containers further can be formed in various shapes and sizes, and decorated with artwork. As a result, metal containers are often used to hold consumer products.

It is important that a metal container adequately retain the product it holds. Many products have a low viscosity, and therefore flow easily through cracks or seams in packaging. For example, products such as lotions, creams, and wax candles are heated during manufacture to obtain a flowable material which is processed and packaged more easily. Furthermore, products such as candles experience elevated temperatures when used for their intended purpose by the consumer, and therefore again create a flowable material. Metal containers used to hold those products must therefore be capable of retaining material having low viscosity.

Previously, glass jars and drawn metal containers have been used to hold easily flowable materials. Those conventional containers are typically formed as single, unitary pieces so that no seams are formed through which the material may leak. Production of these previous containers in varied shapes and sizes requires extensive machine retooling and therefore is overly time consuming and expensive. Furthermore, it is difficult to improve the appearance of these containers with artwork. Relatively deep drawn metal containers, for example, require artwork to be applied to a flat blank in distorted form so that, after the container is drawn into shape, the artwork is bent into the proper visual appearance. Layout and application of distorted artwork is, however, overly difficult and expensive.

Metal containers formed from multiple pieces are known which are less expensive to make in different shapes and sizes and easier to decorate. For example, a standard three-piece metal container has a base and side wall joined together to form the container, and a removable cover. The side wall is formed from a flat strip of metal that is then bent or rolled into a cylinder, square, or other shape, either regular or irregular. The ends of the side wall are joined to complete the shape. The base is generally flat and is formed to fit on a bottom edge of the side wall. Finally, the cover is a separate piece that is sized to removably fit over the top edge of the side wall.

Unfortunately, multiple piece metal containers create an increased risk of product leakage. From the above, it will be evident that a number of seams are formed between the different components of the three-piece metal container. A seam is formed at the side wall along the vertical height of the container where the opposite ends of the metal strip are joined. In addition, a seam is formed around the entire periphery of the side wall where it joins the base. As a result, materials having low viscosity may leak through the seams of the container.

Previous candle containers have employed various approaches to prevent leakage through container seams.

Some containers, for example, have carefully formed seams which are tightly folded. The tight seams, however, are difficult to form and do not reliably prevent leakage. Other containers have used volatile or hazardous materials (such as methyl ethyl ketone(MEK)-based materials) to seal the container seams, and therefore pose a threat to the environment. Furthermore, these materials are typically applied to the container by hand (or "hand-doped") and therefore require expensive manual labor.

A downside of using metal containers to accommodate burning candles is well known and derives from the fact that the thermally conductive nature of metal frequently allows transmission of harmful quantities of heat from not only the flame but from the heated and sometimes liquefied candle wax, which heat passes through the container base to a support surface which maybe damaged, that is scorched by the heat.

Candle flash-over is also a danger. As is known, flash-over can occur when the pool of wax in the bottom of a candle container becomes relatively shallow, the wick bums down to approach the shallow pool and the pool becomes hotter than normal and ultimately reaches a self sustaining combustion temperature at which the wax will burn without a need for a wick. When this happens the candle container may reach temperatures significantly in excess of 600° F. and thereby presents a significant fire hazard.

Pappas, U.S. Pat. No. 5,842,850 describes various approaches to preventing flash-over. These approaches deal primarily with keeping the wick, i.e. the source of candle ignition, sufficiently above the floor of the candle container which makes the flame go out before the fuel temperature exceeds its flash point. The '850 patent typically employs a candle wick sustainer wherein the wick is held in a bore formed in the sustainer. The bore which contains the wick is centrally disposed in vertical column that is supported by a base made impervious to candle fuel which thereby ensures that no candle fuel can reach the wick through the base that supports the bore containing the candle wick.

Because the wick must be in contact with the liquefied wax it burns, it follows that the height of the sustainer column determines when the wick will lose its supply of fuel. The '850 patent indicates that the top end of column extends above the floor of the candle container an amount sufficient to prevent flash-over. In several embodiments the '850 patent includes a centrally disposed pedestal upon which is mounted the afore described candle wick sustainer.

The subject invention distinguishes over the '850 patent in a number of novel and beneficial ways, most significantly in the provision of a sealed metal container, the sidewalls, side seam and base seam of which have been made hermetically secure while at the same time a stamp formed container base uniquely elevates a candle wick holder which functions to deprive the candle wick of burnable wax and prevents possible flash-over. At the same time the unique stamp formed container base isolates heated liquefied fuel to an outer periphery of the container bottom. The unique bottom structure also elevates the burning wick in such a manner that there is provided an insulating air space centrally disposed beneath the burning wick and a surface upon which the metal candle container rests.

SUMMARY OF THE INVENTION

In light of the above, a general aim of the present invention is to provide a seamed metal container having a novel formed base which minimizes flash-over and which is more reliably sealed with a non-hazardous sealing compound to thereby adapt the container for use with relatively low viscous materials.

Another object of the invention is to provide a candle container which is economical to mass produce, yet has a highly effective flash-over prevention and a thermally insulating safety bottom.

In that regard, it is an object of the present invention to provide a seamed metal container which is reliably sealed for use in applications involving elevated temperatures.

A related object of the present invention is to provide a sealed metal container adapted for use with candles which minimizes scorching of the surface on which the container is placed.

It is also an object of the present invention to provide an automated method for sealing a seamed metal container so that it retains flowable materials.

In that regard, it is an object of the present invention to provide an automated method for sealing a seamed metal container which reliably coats the seams of the container.

In light of the above, the present invention provides a seamed metal container having an interior surface coated with a non-hazardous sealing compound. The sealing compound forms a barrier which prevents leakage of flowable, low viscous material through the seams. More particularly, the sealing compound comprises a mixture of synthetic wax with a sufficient amount of adhesive so that the mixture bonds to the interior surface of the container and seals the seams.

It is also a feature of the present invention to provide a support ridge around the base of the metal container which spaces the base from the surface on which the container is placed. The support ridge is formed about the periphery of the base so that, when the container is placed on a surface, only the ridge is in contact with that surface. As a result, when the container holds a material at an elevated temperature, such as a burning candle, a majority of the base is spaced from the surface to create an insulating pocket of air which reduces scorching of the surface by the base.

The present invention further provides a method for reliably sealing a seamed metal container which is automated and therefore reduces labor costs. The method requires the sealing compound to be heated, pressurized, and sprayed through a nozzle. The nozzle is inserted inside an uncoated container and moves along the length of the container as it sprays to coat an interior surface.

Lastly the present invention provides a sealed metal container for holding a supply of relatively low viscous flammable material and a candle wick. The container includes a stamp formed base that has top and bottom faces. A formed sidewall member mechanically engages the top face of the base to form a mechanical bottom seam that functions as a depending annular surface support ridge. Opposing ends of the sidewall member mechanically engage one another to form a mechanical side seam. The sidewall member and the top face of the base define an inside surface of the container. A sealing compound is bonded to the inside surface, the bottom seam and the sidewall seam to thereby establish leak-proof sealed bottom and sidewall seams. The stamp formed base is characterized by having an internally upwardly directed dome upon which a candle wick carrying element may be securely located. The upwardly directed dome establishes an annular internal volume of low viscous flammable material separated by the dome from the candle wick near the end of the candle wick life and the supply of flammable material which thereby minimizes flash-over while reducing heat transfer from the low viscous flammable material to and through the annular surface support ridge. The shape of the dome may be optimized to prevent accumulation of carbon balls or particles near the wick, thus avoiding another source of flash-over.

These and other objects, advantages, and features of the invention will become more apparent from the following detailed description when taken in conjunction with the accompanying drawings.

BRIEF DESCRIPTION OF THE DRAWINGS

FIG. 2 is a cross-sectional side view of the metal container taken along line 2—2 of FIG. 1.

FIG. 3 is a cross-sectional side view of the metal container taken along line 3—3 of FIG. 1.

Figure 1:
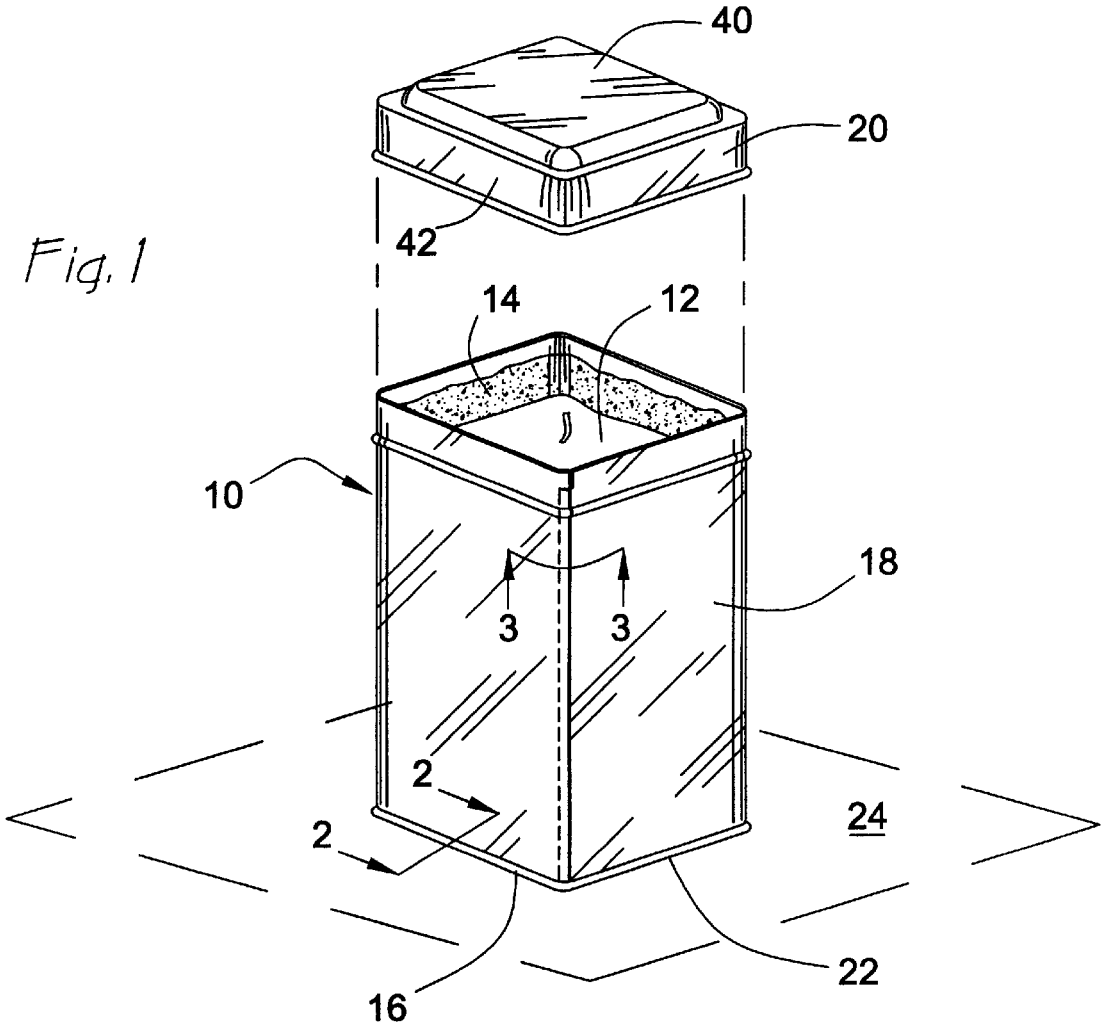
FIG. 1 is a perspective view of a seamed metal container constructed in accordance with the present invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents failing within the spirit and scope of the invention as defined by the appended claims.

DETAILED DESCRIPTION OF THE PREFERRED EMBODIMENT

For purposes of illustration, the invention is shown in FIG. 1 as embodied in a sealed metal container 10 adapted to hold a product such as a candle 12. The interior of the container 10 is coated with a sealing compound 14 which prevents flowable material, such as melted candle wax, from leaking from the container. While the present invention has been illustrated as holding a candle, it will be appreciated that the sealed metal container 12 is capable of holding a wide variety of products, including liquids having a relatively low viscosity. The sealing compound 14 comprises a synthetic wax and an adhesive, as will be described below.

Referring to the container 10 in greater detail, it will be seen that the container generally comprises a base 16, a side wall 18, and a cover 20. As best shown in FIG. 2, the base 16 is formed with a depending ridge 22 extending about a periphery of the base 16. The ridge 22 spaces the bottom face 26 of the base 16 from a support surface 24 on which the container is placed, such as a table. The ridge 22 therefore creates an insulation space 28 between the bottom face 26 of the container and the support surface 24. As a result, only the ridge is in contact with the support surface 24, thereby reducing the area on the support surface which may be scorched when the container 10 is at an elevated temperature.

The side wall 18 comprises a single strip of relatively thin sheet metal which is formed into a shape corresponding to that of the base 16. As best shown in FIG. 3, the side edges 31, 32 of the side wall 18 engage one another to complete the shape of the container 10. The side wall 18 has an inside face 33 which meets the top face 35 of the base to define an interior container surface. The side edges 31, 32 of the side wall 18 are folded over one another to form a side seam 34. A bottom edge 36 of the side wall 18 is folded with an outside edge 27 of the base 16 to form a bottom seam 38 around the entire perimeter of the container 10. In the illustrated embodiment, the side wall 18 is formed to have a generally square shape, however rectangular, circular, or other shapes (both regular and irregular) may also be formed.

The cover 20 is provided for closing the top of the container 10. As shown in FIG. 1, the cover 20 has a flat portion 40 with a depending wall 42. The shape of the wall 42 corresponds to that of the side wall 18. The wall 42 is sized so that it may be installed over a top portion of the side wall 18 and held in place in a press-fit manner. The cover 20 may be removed by pulling up on the cover until the wall 42 disengages the side wall 18.

In accordance with certain aspects of the present invention, the interior surface of the container 10 is coated with the sealing compound 14 to prevent flowable material from leaking through the side and bottom seams 34, 38. As best shown in FIGS. 2 and 3, a layer of sealing compound 14 bonds with the interior surface of the container 10, which includes the inside face 33 of the side wall 18 and the top face 35 of the base 16. The sealing compound 14 prevents flow of material through the seams 34, 38.

In accordance with the present invention, the sealing compound 14 must be sufficiently hard to form a substantially impermeable layer but flexible enough to minimize cracking. As noted above, the container 10 is preferably made of relatively thin sheet metal and therefore is somewhat flexible. The sealing compound 14 must therefore bond with the interior surface and withstand deflections without cracking. A testing protocol for measuring flexibility is provided under ASTM D 2794, incorporated herein by reference. ASTM D 2794 provides a standard test method for resistance of organic coatings to the effects of rapid deformation. Under the method, organic coatings are applied to a thin metal panel. A weight is then dropped a known distance to strike the metal panel, thereby deforming the coating. The distance the weight drops is increased until failure, which takes the form of cracking. According to this method, it has been found that a preferable range of flexibility for the sealing compound 14 is between approximately 10 and 20 inch-pounds, and most preferably about 12 inch-pounds.

A protocol for testing hardness is provided under ASTM D 1321-95, incorporated herein by reference. ASTM D 1321-95 provides a standard test method for needle penetration of petroleum waxes. A test sample is heated to a test temperature and a needle is inserted into the sample at a given load for a given period of time. Hardness is measured by the amount of needle penetration into the sample. Using this test, it has been found that a suitable range of hardness for the sealing compound is between 0.01 and 0.3 millimeters when using a 100 gram load on the needle inserted for 5 seconds into the sealing compound heated to 25° C. (0.01–0.3 mm for 100 g/5 secs/25° C.).

The sealing compound 14 is relatively inert so that it does not react with the material stored in the container or heat generated during manufacture or use of the product. The sealing compound 14 further contains minimal volatile organic compounds and therefore does not pose a threat to the environment. Furthermore, the sealing compound 14 is spread relatively easily and evenly over the interior surface of the container 10. Accordingly, the sealing compound preferably has a viscosity of between 1.0 to 200 centiPoise (cP), and most preferably 150 cP, on a Brookfield Thermosel at 190° C., to ensure complete coverage.

In the preferred embodiment, the sealing compound 14 is specifically adapted for use with products which are heated during manufacture or generate heat during use. For example, candle wax is typically heated to approximately 70° C. during manufacture so that it may easily be poured into containers. When the candle is subsequently burned, the wax melts at approximately 50–80° C. The melting point of the sealing compound 14 is therefore greater than at least 80° C. and is preferably no less than approximately 102° C. for applications involving heat.

It has been found that a mixture of synthetic wax and adhesive material creates a sealing compound having the above-identified characteristics. The sealing compound may generally be identified as a hydrocarbon hot melt spray compound comprising a mixture of a polyethylene as the synthetic wax and an alkylated cycloaliphatic hydrocarbon as the adhesive. In the most preferred embodiment, the synthetic wax is a polyethylene such as that marketed by Eastman Chemical Company of Kingsport, Tenn. under the trade name "EPOLENE N-14", however similar products (such as "EPOLENE N-10", "EPOLENE N-21", and "EPOLENE N-20") or other known substitutes may also be used. The adhesive is preferably an alkylated cycloaliphatic hydrocarbon such as that marketed by Eastman under the trade name "EASTOTAC RESIN H-100R", although similar products (such as "EASTOTAC RESIN H-100E) or other known substitutes may also be used.

Proper proportions of synthetic wax and adhesive are used so that the sealing compound adheres to the container 10 and displays the desired characteristics noted above. We have determined that a mixture, by weight, of approximately 10–90% polyethylene and a corresponding 90–10% of alkylated cycloaliphatic hydrocarbon forms a hydrocarbon hot melt spray sealing compound which adequately bonds to the interior surface and seals the seams of the container 10. In the most preferred embodiment, the sealing compound comprises 50% synthetic wax and 50% adhesive. Significantly, the wax and adhesive mixture contains minimal volatile organic compounds and therefore does not pose a threat to the environment.

Figure 5:
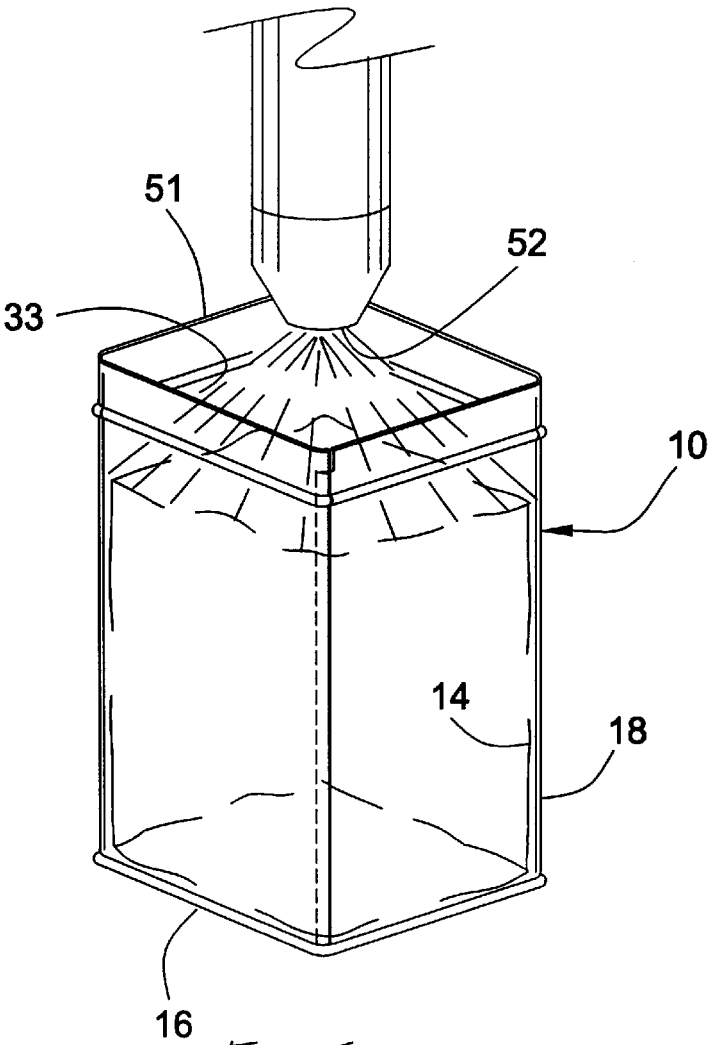
FIG. 5 is a partially schematic representation similar to FIG. 4 showing the nozzle positioned near the top of the container.
Figure 4:
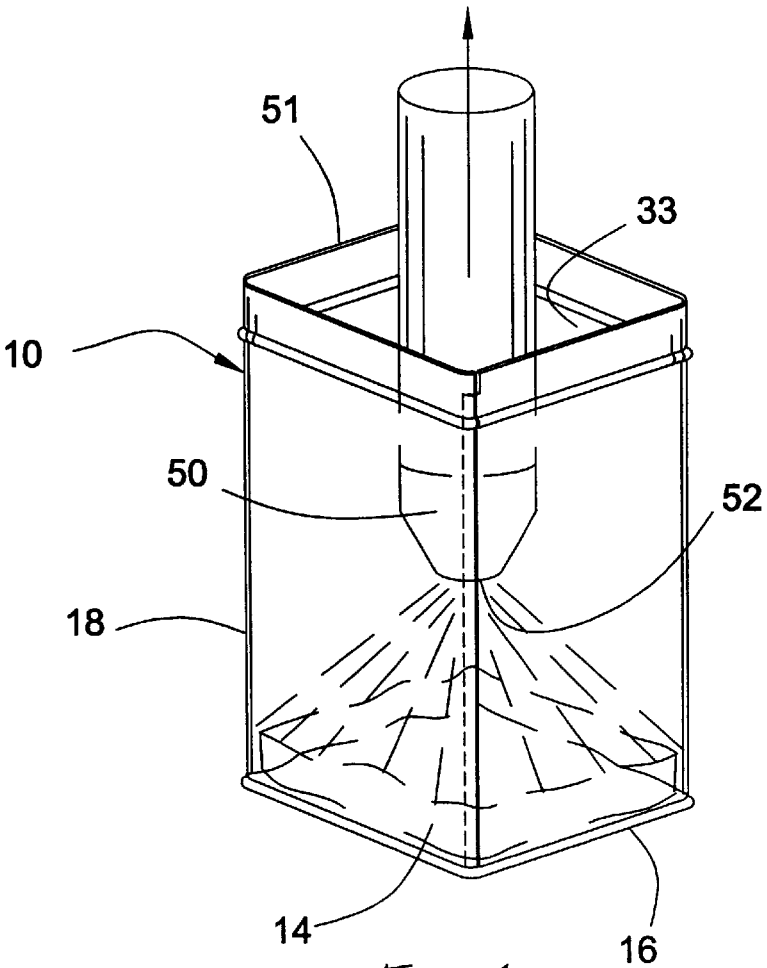
FIG. 4 is a partial schematic representation of the equipment used to spray a sealing compound over the interior of the container showing a nozzle positioned near the base of the container.

The present invention also provides an automated method for sealing a three-piece container 10 with sealing compound. The method comprises heating and pressurizing the sealing compound so that it is sufficiently flowable for discharge through a nozzle 50 FIG. 4. The preferred hydrocarbon hot melt compound described above is heated to a temperature of approximately 102–190° C. to melt the sealing compound. The compound is then pressurized to approximately 1000 psi and pumped through a nozzle 50 toward the interior surface of the container 10. As noted above, the compound preferably has a viscosity of roughly 1.0–200 cP on a Brookfield Thermosel at 190° C. The relatively low viscosity of the sealing compound 14 not only allows the compound to be sprayed, but also ensures that the compound will adequately spread to cover the entire interior surface. To apply sealing compound to an uncoated container, the nozzle 50 is inserted inside the container near the base 16, as shown in FIG. 4. Sealing compound 14 is pumped through the nozzle 50 and directed toward the interior surface of the container 10. The nozzle continues to spray sealing compound as it is actuated toward the top 51 of the container 10 so that the entire interior surface is covered (FIG. 5). The nozzle 50 has a round orifice 52 sized to coat the interior surface with a sufficient thickness of sealing material. For example, as shown in FIGS. 4 and 5, the side wall 18 of container 10 has a generally square shape, and therefore the nozzle orifice 52 must be sized to reach the corners of the container 10. It has been found that a nozzle orifice diameter of approximately 0.03–0.07" is sufficient to cover distances up to 3 inches from the center of the nozzle.

The sealing compound 14 must also be applied in the proper thickness. While the hydrocarbon hot melt spray compound must be applied sufficiently thick to completely cover the interior surface of the container, the sealing compound loses some of its flexibility and tends to crack and pull away from the container 10 if it is applied too thick. Accordingly, it has been found that the sealing compound should be applied in a thickness of between about 0.03–0.08" to avoid cracking. In the preferred embodiment, the sealing compound has a thickness of approximately 0.05".

During the sealing operation, the container 10 may be heated to ensure that the interior surface is completely coated with sealing compound 14. For larger container sizes in particular, it has been found that the melted sealing compound cools as it travels from the nozzle to the interior surface. The cooling increases the viscosity of the sealing compound, thereby decreasing the amount of interior surface area covered. To help ensure maximum coverage, the container 10 is heated to maintain the temperature, and therefore the viscosity, of the sealing compound 14. In this embodiment, the container 10 is preferably heated to approximately 125° C. In a practical implementation it is sometimes found acceptable to heat the container to only about 200° F., which creates a temperature in the can bottom of about 180° F.

To further improve coverage of the interior surface, the container 10 is rotated during spraying. As noted above, the sealing compound has a referred viscosity which allows the compound to spread once it contacts the container 10. In a preferred embodiment, the container 10 is rotated during spraying to increase the amount of spread and therefore more reliably coat the entire interior surface. While any amount of rotation is beneficial, the container 10 is preferably rotated at speeds of at least around 100 rpm to provide more consistent coverage. Rotation of the container 10 ensures that the sealing compound spreads and penetrates the seams before it cools and solidifies.

Figure 6:
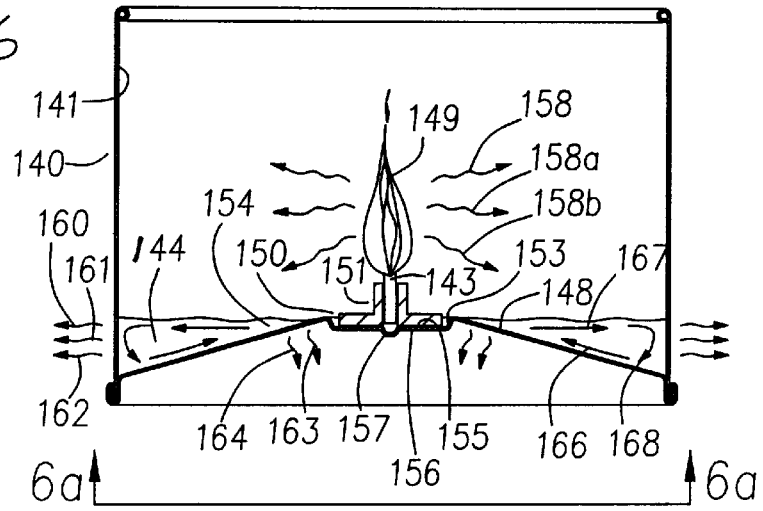
FIG. 6 is a cross-section of a seamed metal container depicting a domed base embodying the invention.

The thermal dynamic nature of flash-over prevention uniquely afforded by the subject invention can now be explained in conjunction with the illustration of the invention as it is embodied in FIG. 6.

Figure 6A:
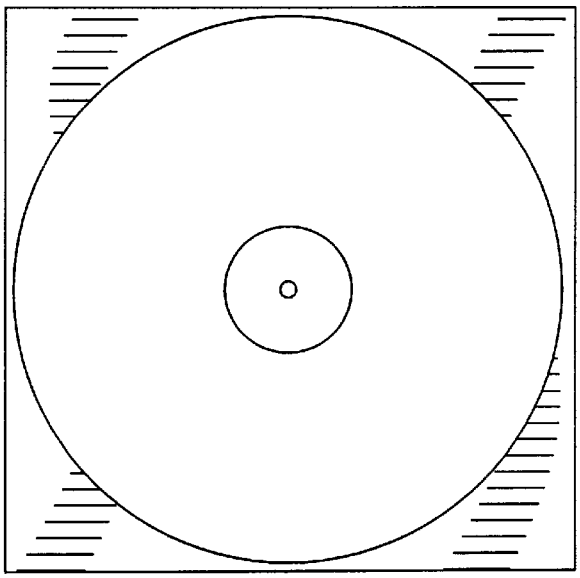
FIG. 6*a* is a bottom view of the metal container of FIG. 6.
Figure 6B:
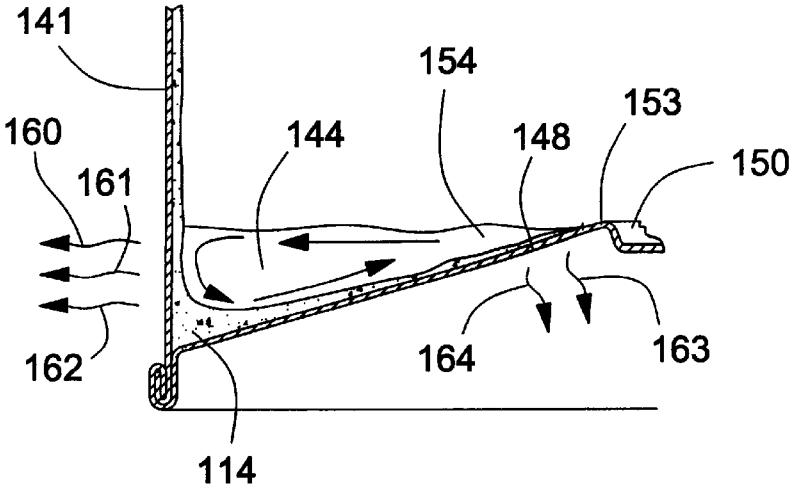
FIG. 6*b* is an enlarged partial section of a lower left hand corner of FIG. 6.

FIG. 6 shows in full section the detailed construction of a stamp formed base 147 of a sealed metal container 140. FIG. 6, 6*a* and 6*b* should be studied together to better appreciate the nature of the subject invention. In the condition shown a candle wick 143, its flame 149 and candle wax supply 144 are displayed in the way the candle wax supply would appear near the end of both the life of the candle wick 143 and candle wax 144. It will be observed that there is provided a cone shaped dome structure 148 that cooperates with a sidewall 141 to create the annular pool of wax 144 with an overall shape of a donut that includes an inwardly directed region 154 of increasingly diminishing depth in the vicinity of a lip 153 of a dish shaped invention 150 in the apex region of the cone shaped dome structure 148. The sealing compound 114 is shown distributed along the surface of the cone shaped dome 148 and sidewall 141.

As the temperature of the candle wax 144 increases due to radiant energy e.g. wiggly arrows 158, 158*a* 158*b* from candle flame 149, the wax viscosity also decreases. It is known that a decrease in liquefied candle wax viscosity enhances capillary movement of liquefied wax in the wick 143.

It will be appreciated in a study of FIG. 15 that the candle wick 143 and a wick holder 151 positioned in dish shaped indentation 150 receives its liquefied wax via a thin film of liquefied wax 155 that exists between the wick holder 151 and a planar bottom 156 of the dish shaped indentation 150. The planar bottom also may include a dimpled or slight depression 157 centrally disposed within the dish shaped indentation 150. This depression 157, which has a primary function of accommodating the wick should it protrude below the base of the wick holder, creates a small pool of liquefied wax which cooperates with candle wick 143 by means of capillary action to furnish fuel via the wick 143 for the candle flame 149.

The slope of the conically shaped wall 148, coupled with the effect of gravity on the heated liquid wax, cooperate to cause heated liquid wax in the inwardly directed region 154 of molten wax near the lip 153 to move first upwardly along the conically sloped wall 148 and then outwardly as convection flow arrows 166, 167, 168 indicate. This results in molten wax moving towards the center of the container 140 where the candle wick 143 is mounted in candle wick holder 151. The lip 153 creates a sharp or definitive interruption to the conically sloped wall 148 which prevents the molten wax from entering the dish shaped indentation 150. With no liquefied wax entering the dish shaped indentation, the liquefied wax 155 between the wick holder 151 and its wick 143 is soon depleted and the wick 143 and flame 149 are starved for fuel and the flame 149 quickly goes out. The metal composition of the conically shaped dome 148 in the vicinity of the lip 153 of the dish shaped structure and the metal sidewall 141 cooperate to provide a thermal mechanism to simultaneously allow radiation cooling of heated wax as indicated by wiggly shaped arrows 160, 161, 162, 163 and 164 to thereby diminish the temperature of the liquefied wax and further minimize the possibility of flash-over.

Figure 7:
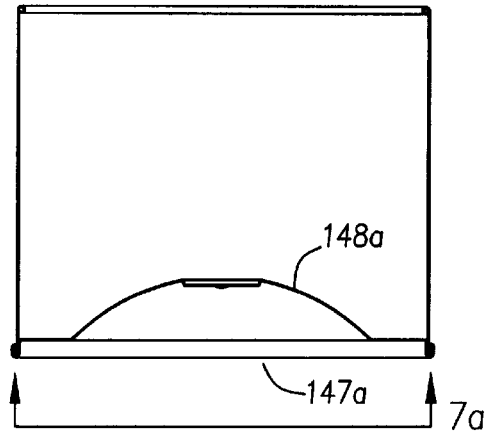
FIGS. 7, 8 and 9 are partial sections of seamed metal containers illustrating different embodiments of the invention whereas as FIGS. 7*a*, 8*a*, and 9*a* are bottom view of FIGS. 7, 8 and 9, respectively.
Figure 8:
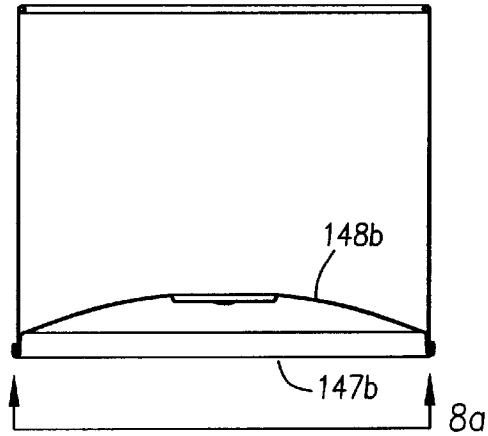

FIGS. 7 and 8 exemplify two additional embodiments of the stamp formed container base 147*a* and 147*b* that are useful variations of the subject invention.

Figure 7A:
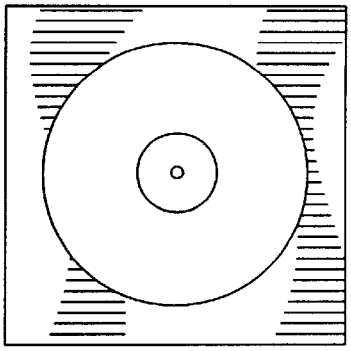

When FIG. 7 and FIG. 7*a* are taken together it will be appreciated that the stamp formed dome 148*a* is centered in the bottom of container 140*a*. This arrangement is useful when the container is relatively large.

Figure 8A:
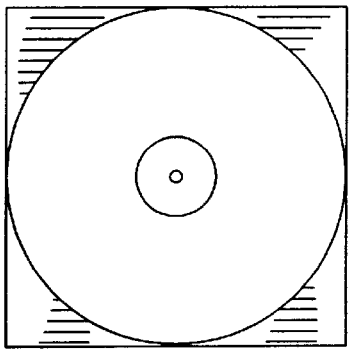

When FIG. 8 and 8*a* are taken together it will be appreciated that the stamp formed dome 148*b* has a uniform curvature and entirely spans the base. This bottom configuration results in a savings of total wax required.

The embodiments of FIGS. 6–8 all show the feature of a dish shaped indentation at the apex of the dome. Among the features provided by the dish shaped structure is the ability to positively locate the base of the wick holder. However, that feature is provided at the expense of a slight, but measurable, decrease in elevation of the wick holder. In some situations, it is possible to dispense entirely with the dish shaped indentation. Particularly, when the candle manufacturer adopts a process by which the base of the wick holder is glued to the bottom of the can (as by a drop of adhesive applied just before positioning the wick holder) the dish shaped depression may be dispensed with, particular in the case where the pedestal will provide a definite target to receive the base of the wick holder to assure its centering.

Figure 9:
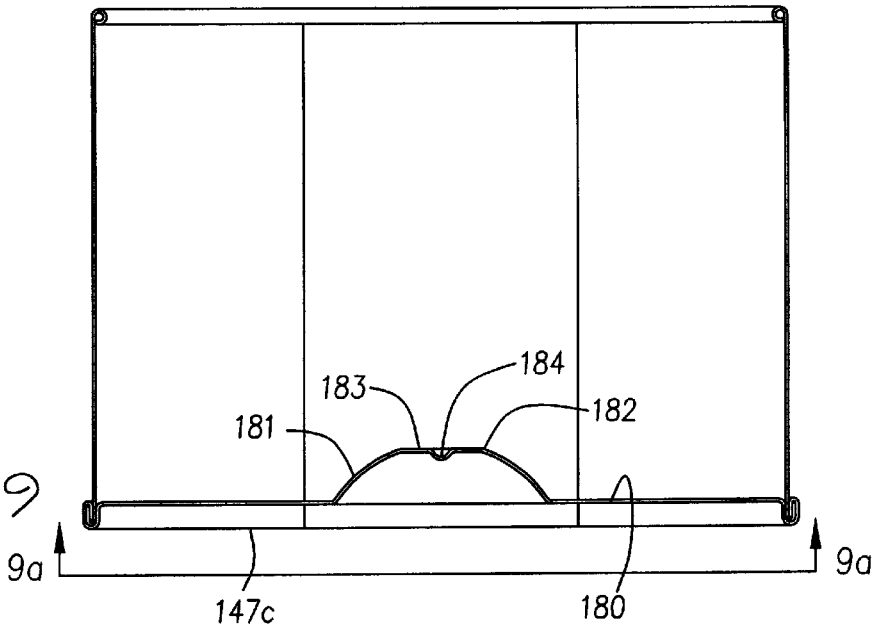
Figure 9A:
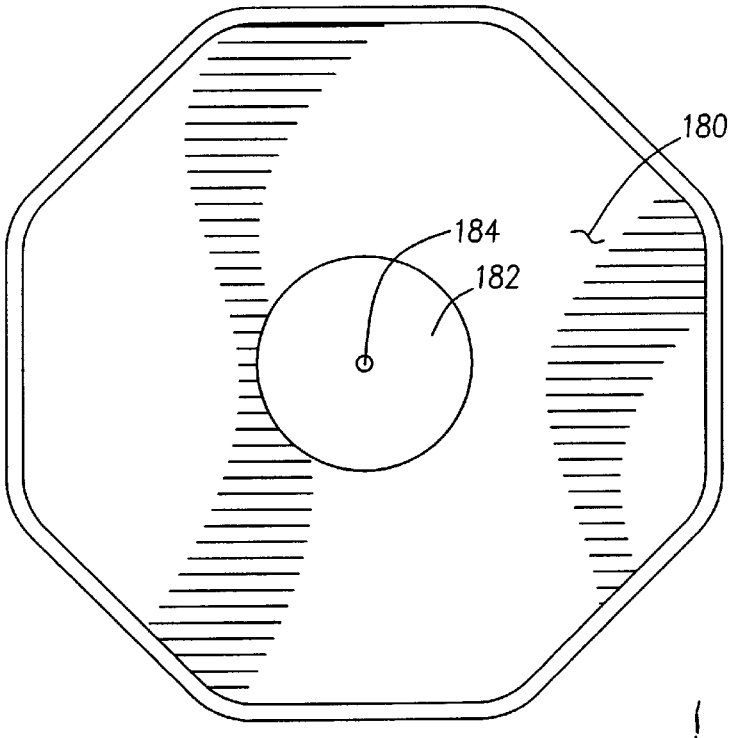
FIG. 9*b* is a partial section of the bottom structure of the metal container depicted in FIG. 9 with an associated wick.

Such an arrangement it illustrated in the currently preferred embodiment of FIGS. 9 and 9a. It will be appreciated, however, that the flat-top domed structure of these figures can be accommodated in any of the previous embodiments, where desired.

Figure 9B:
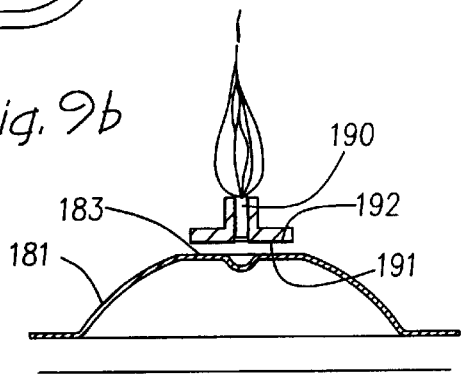

The embodiment of FIGS. 9 and 9*a* illustrates the approach of providing a bottom structure 147*c* having a relatively flat peripheral portion 180 and a smaller diameter but rapidly rising dome structure 181 at the center thereof. The dome structure has relatively sharply rising walls 182 which terminate in a flat, undepressed plateau 183 at the center thereof. A dimple 184 can be provided in the center of the top plateau 183. In practice, a wick holder 190 (see partial view FIG. 9*b*) is positioned atop the plateau 183 of the dome 181 and held in place by means of adhesive 191 between the base 192 of the wick holder 190 and the plateau 183. A drop of adhesive can be applied to the base of the wick holder before it is put in position, the adhesive being sufficiently tacky to maintain the position of the wick holder during the candle pouring operation.

The candle bottom structure of FIG. 9 has been found to provide a further benefit over certain of the earlier embodiments. When a candle has burned for a considerable length of time, carbon balls tend to collect in the wax. The carbon balls can form from dislodged and burnt bits of the wick, from a portion of the match which is used to light the candle, or other sources. It is also known that if the carbon balls are concentrated in the center of the can, near the wick which generated them, they will serve as a further source of ignitable material and exacerbate the flash-over problem.

We have found that the shape of the domed configuration can have a material effect on the location of the carbon balls as the candle burns to the extinguishment point. More particularly, with the more gently shaped dome structures, such as in FIG. 8, the carbon balls tend to collect where they fall, very near the base of the wick holder. As in that configuration, they sometimes themselves ignite, triggering the flash-over problem.

We have found that with a base structure of the type shown in FIG. 9, the carbon balls tend to disperse away from the center of the candle, because of the relatively sharply sloped sides of the dome. We have found that with the dome as generally depicted in FIG. 9, the carbon balls will move a sufficient distance from the center of the flame that they are unlikely to serve as a secondary ignition source and trigger flash-over.

The degree of slope of the walls of the dome is dependent on a number of factors. One of them is the carbon ball positioning problem, and for that the walls should be as sharp as possible as illustrated in FIG. 9. However, that configuration suffers from the disadvantage of a relatively large volume of wax remaining in the can after the wick is extinguished. The shape of FIG. 8, however, has much less wax remaining in the can after extinguishment, although at the expense of less travel of the carbon balls from the center of container. Depending on the size of the container and other factors, including the end use of the final candle, these factors can be balanced to achieve a desired result in accordance with the present invention. In all cases, however, the finished product is of the same variety, with the seams reliably sealed for use in applications involving elevated temperatures.

From the forgoing, it will be appreciated that the present invention brings to the art a sealed metal container which reliably retains relatively low viscous materials. The interior surface of the container is coated with a sealing compound which retains relatively lower viscosity materials. The sealing compound comprises a mixture of synthetic wax with sufficient adhesive so that the compound bonds to the surface of the container and seals the seams to prevent material from leaking out of the container. Furthermore, the sealing compound is non-hazardous. The present invention also provides an automated method for sealing a seamed metal container with sealing compound. The method comprises heating and pressurizing the sealing compound so that it may be sprayed through a nozzle. The nozzle is placed inside the uncoated container and discharges as it travels the height of the container to cover the interior surface. The container may be preheated and rotated during spraying to more reliably cover the entire interior surface.

The utility of invention is further enhanced when the container base is stamp formed to create a dome upon which a candle wick holder may be positioned thereby significantly reducing the possibilities of flash-over and any thermal damage to a supporting surface for the container. The dome has a flat mounting surface for receiving a wick holder and the flat mounting surface may be located at the apex of the dome, or slightly depressed in a dish-shaped indentation adapted to receive and locate the wick holder.

What is claimed is:

1. A sealed metal container for holding a supply of relatively low viscous flammable material, and a candle wick, the container comprising:

a stamp formed base having top and bottom faces, a formed sidewall member mechanically engaging the top face of the base to form a mechanical bottom seam that functions as a depending annular surface support ridge, opposing ends of the side wall member mechanically engaging one another to form a mechanical side seam, the side wall member and top face of the base defining an inside surface of the container, and a sealing compound to the inside surface, the bottom seam and the sidewall seam to thereby establish bottom and sidewall seams adequately sealed to prevent passage of the low viscous flammable material, the stamp formed base including an internally upwardly directed dome having a flat mounting surface upon which a candle wick carrying element maybe securely located.

2. The sealed container of claim 1 in which the sealing compound includes a mixture of synthetic wax and adhesive, the compound having a sufficient fraction of adhesive to allow bonding of the compound to the inside surface of the container, the bottom seam and the sidewall seam, the sealing compound when bonded having a flexibility of approximately 10 to 20 inch-pounds, a hardness of approximately 0.01 to 0.3 mm for 100 g/5 secs/25° C., and a melting point of at least 80° C.

3. The sealed container of claim 1 which includes therein a low viscous flammable material, and a dish shaped indentation in the apex region of the dome including at an outer periphery of the dish shaped indentation a raised lip that establishes a discontinuity in a surface of the dome at the edge of the indentation, the discontinuity effectively interrupting the flow of flammable material to the candle wick when a candle wick flame nears the end of both the candle wick life and the supply of flammable material thereby minimizes flash-over.

4. The sealed container of claim 1 which includes therein a low viscous flammable material, and a flat topped plateau in the apex region of the dome, the dome descending from the apex rather sharply to a flat bottom structure, the dome and plateau occupying substantially less than fifty-percent (50%) of the area of the stamp formed base.

5. The sealed container of claim 1 which includes therein a low viscous flammable material and in which the intersection of the sidewall and the upwardly directed dome of the container base establishes an annular internal volume of the low viscous flammable material separated by the dome from a candle wick flame near the end of both the candle wick life and the supply of flammable material which thereby minimize flash-over while thereby reducing heat transfer from the low viscous flammable material to and through the annular surface support ridge to the support surface.

6. The sealed container of claim 5 in which the sealing compound includes a mixture of synthetic wax and adhesive, the compound having a sufficient fraction of adhesive to allow bonding of the compound to the inside surface of the container, the bottom seam and the sidewall seam, the sealing compound when bonded having a flexibility of approximately 10 to 20 inch-pounds, a hardness of approximately 0.01 to 0.3 mm for 100 g/5 secs/25 C., and a melting point of at least 80° C.

7. The sealed container of claim 6 wherein the dome is cone shaped.

8. The sealed container of claim 6 in which the dome occupies less than fifty-percent (50%) of the area of the can bottom and rises from a flattened horizontal portion thereof.

9. The sealed container of claim 8 is which the dome has a flat top.

10. The sealed container of claim 6 wherein the dome shape has a uniform radius of curvature except in the area of the dish shaped indentation of the dome.

11. The sealed container of claim 6 wherein the dome entirely spans the container base.

12. The sealed container of claim 6 wherein the dome is centered in the container base between the continuous sidewall and the dome is also spaced from the sidewall.

13. The sealed container of claim 3 in which the sealing compound includes a mixture of synthetic wax and adhesive, the compound having a sufficient traction of adhesive to allow bonding of the compound to the inside surface of the container, the bottom seam and the sidewall seam, the sealing compound when bonded having a flexibility of approximately 10 to 20 inch-pounds, a hardness of approximately 0.01 to 0.3 mm for 100 g/5 secs/25 C., and a melting point of at least 80° C.

14. The sealed container of claim 13 wherein the dome is cone shaped.

15. The sealed container of claim 13 in which the dome occupies less than fifty-percent (50%) of the area of the can bottom and rises from a flattened horizontal portion thereof.

16. The sealed container of claim 13 is which the dome has a flat top.

17. The sealed container of claim 13 wherein the dome shape has a uniform radius of curvature except in the area of the dish shaped indentation of the dome.

18. The sealed container of claim 13 wherein the dome entirely spans the container base.

19. The sealed container of claim 13 wherein the dome is centered in the container base between the continuous sidewall and the dome is also spaced from the sidewall.

* * * * *

UNITED STATES PATENT AND TRADEMARK OFFICE

CERTIFICATE OF CORRECTION

PATENT NO. : 6,155,451
DATED : December 5, 2000
INVENTOR(S) : Walter P. Pietruch et al.

It is certified that error appears in the above-identified patent and that said Letters Patent is hereby corrected as shown below:

Title page,
Item [75], the following inventors should be added:
-- Chet Wright, Rockford, IL
Richard L. Peterson, Roscoe, IL --

Signed and Sealed this

Second Day of December, 2003

JAMES E. ROGAN
*Director of the United States Patent and Trademark Office*